US008661585B1

(12) United States Patent
Alasfour

(10) Patent No.: US 8,661,585 B1
(45) Date of Patent: Mar. 4, 2014

(54) MULTI-POSITION BED FOR THE INFIRM

(71) Applicant: Faisal A. O. Alasfour, Alsheab (KW)

(72) Inventor: Faisal A. O. Alasfour, Alsheab (KW)

( * ) Notice: Subject to any disclaimer, the term of this patent is extended or adjusted under 35 U.S.C. 154(b) by 0 days.

(21) Appl. No.: 13/889,294

(22) Filed: May 7, 2013

(51) Int. Cl.
*A61G 7/02* (2006.01)
*A61G 7/015* (2006.01)
*A61G 7/053* (2006.01)

(52) U.S. Cl.
USPC ..... 5/604; 5/606; 5/613; 5/81.1 RP; 5/81.1 HS

(58) Field of Classification Search
USPC ..... 5/604–606, 695, 11, 611, 81.1 RP, 5/81.1 HS, 81.1 R, 613, 617, 600, 722, 5/723
See application file for complete search history.

(56) References Cited

U.S. PATENT DOCUMENTS 2,500,544 A * 3/1950 Haskins ..... 4/480
2,869,614 A * 1/1959 Wamsley ..... 280/230
3,050,741 A * 8/1962 Coleman ..... 4/480
4,258,445 A 3/1981 Zur
4,282,613 A * 8/1981 Violante ..... 5/604
4,856,123 A * 8/1989 Henderson et al. ..... 4/480
4,910,816 A * 3/1990 Lansing ..... 5/604
5,535,464 A * 7/1996 Salonica ..... 5/604
8,510,881 B1 * 8/2013 Lee ..... 5/604

FOREIGN PATENT DOCUMENTS

CN 101427965 A 5/2009
CN 201492603 U 6/2010

* cited by examiner

*Primary Examiner* — Robert G Santos
(74) *Attorney, Agent, or Firm* — Richard C. Litman

(57) ABSTRACT

The multi-position bed for the infirm or physically disabled patients includes a multi-positional support surface. The support surface includes separate pivotally attached segments adapted to support various parts of a patient's body. Segmented lower portions support the patient's feet and lower legs. An upper segment supports the patient's back, neck and head. A central segment is adapted to support patient's buttocks. All portions can be pivoted through a range of positions. The central segment is provided with movable panels, which can be arranged to form an opening in the bed. A toilet is fixed beneath the bed in alignment with the formed opening. The entire support surface can be vertically adjusted.

11 Claims, 7 Drawing Sheets

MULTI-POSITION BED FOR THE INFIRM

BACKGROUND OF THE INVENTION

1. Field of the Invention

The present invention generally relates to medical appliances, and particularly to a multi-position bed for the infirm and/or physically disabled.

2. Description of the Related Art

Providing adequate care for patients who are infirm, bedridden, and/or physically challenged can be a demanding task, even for professional personnel (nurses, licensed caregivers, etc.). It can be an especially daunting task if the caregiver is a spouse, relative or other person untrained in the intricacies of providing care for infirm and/or bedridden patients. The need to alter the position of the patient to prevent circulatory problems and bed sores or to position the patient to provide for toilet functions can be very difficult. The related art is replete with adjustable beds designed to allay the discomfort of patients and to assist caregivers when repositioning patients. Unfortunately, the related art beds have proven to be uncomfortable, inefficient and/or difficult to operate. The medical industry would welcome an adjustable bed that would provide comfort for the patient and efficient easy operational means for the caregiver. Thus, a multi-position bed for the infirm solving the aforementioned problems is desired.

SUMMARY OF THE INVENTION

The multi-position bed for the infirm comprises a multi-positional support surface. The support surface includes separate pivotally attached segments adapted to support various parts of a patient's body. Segmented lower portions support the patient's feet and lower legs. An upper segment supports the patient's back, neck and head. A central segment is adapted to support the patient's buttocks. All segments can be pivoted through a range of positions. The central segment is provided with movable panels, which can be arranged to form an opening in the bed. A toilet is fixed beneath the bed in alignment with the formed opening. The entire support surface can be vertically adjusted. The upper segment can be independently raised and rotated through a range of 360 degrees.

Accordingly, the invention presents a multi-positional bed that is usable to support infirm or physically disabled patients. The bed is readily adjustable to accommodate a variety of support positions for the patient. The bed may be employed for use in hospitals, nursing facilities, and private homes. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
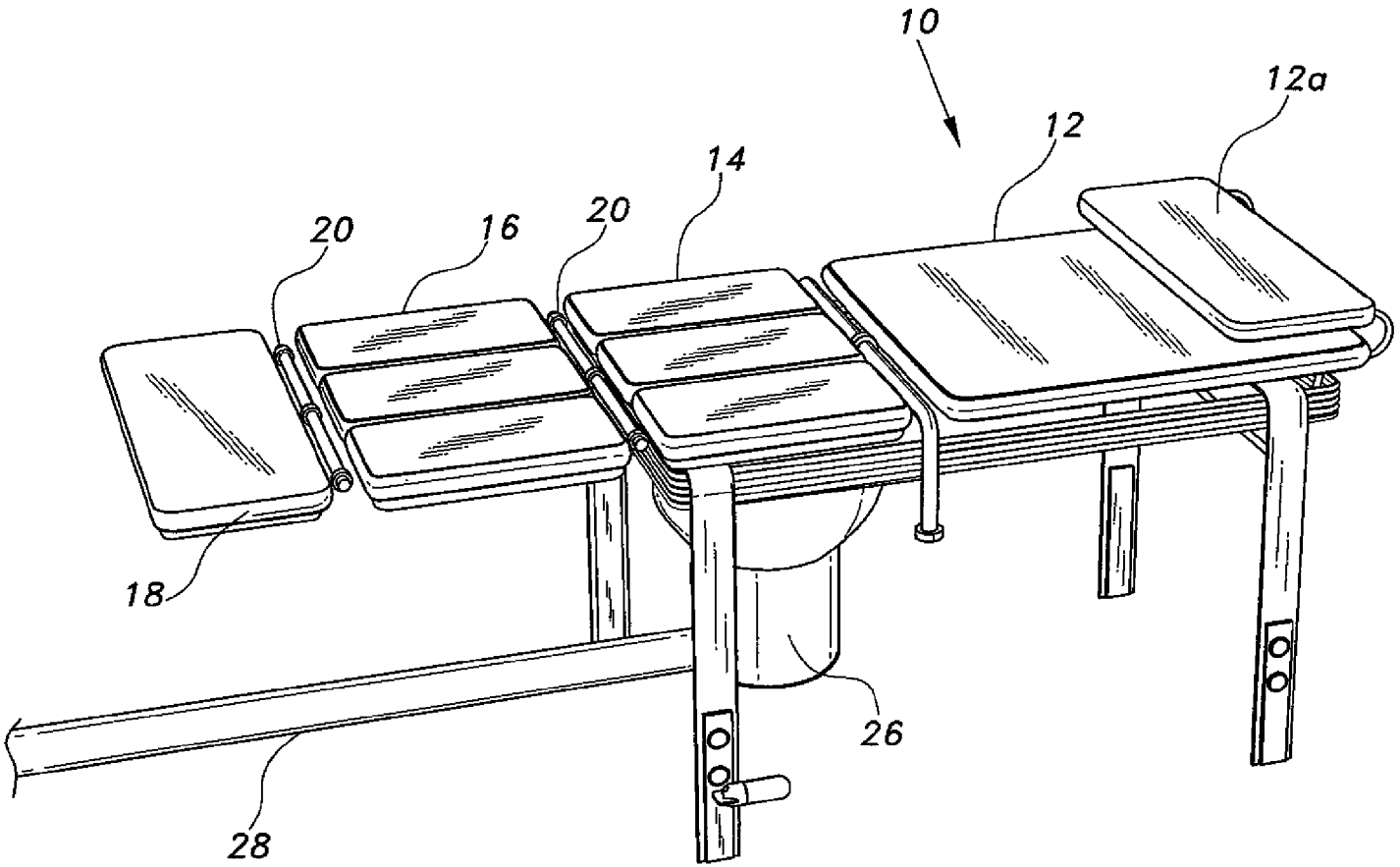
FIG. 1 is a perspective view of a multi-position bed for the infirm according to the present invention, shown in a lowered position.
Figure 2:
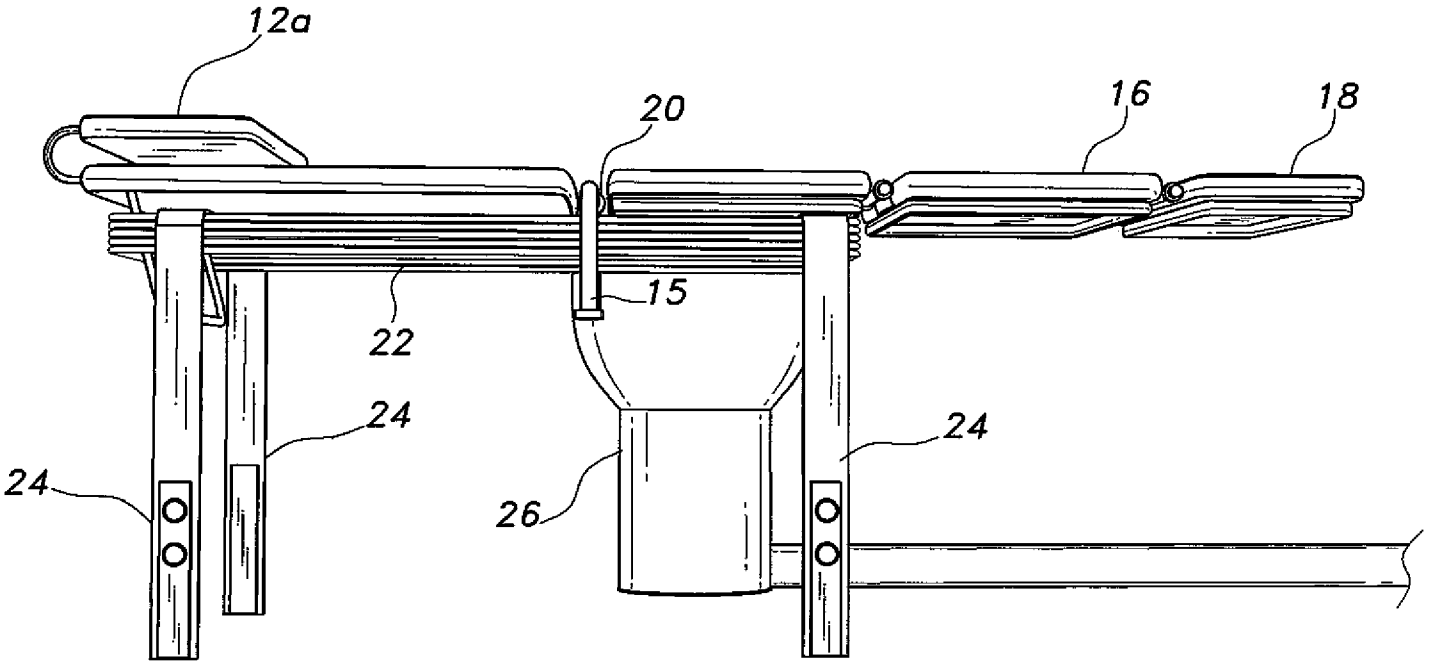
FIG. 2 is a perspective view of the multi-position bed of FIG. 1, shown in a raised position.
Figure 3:
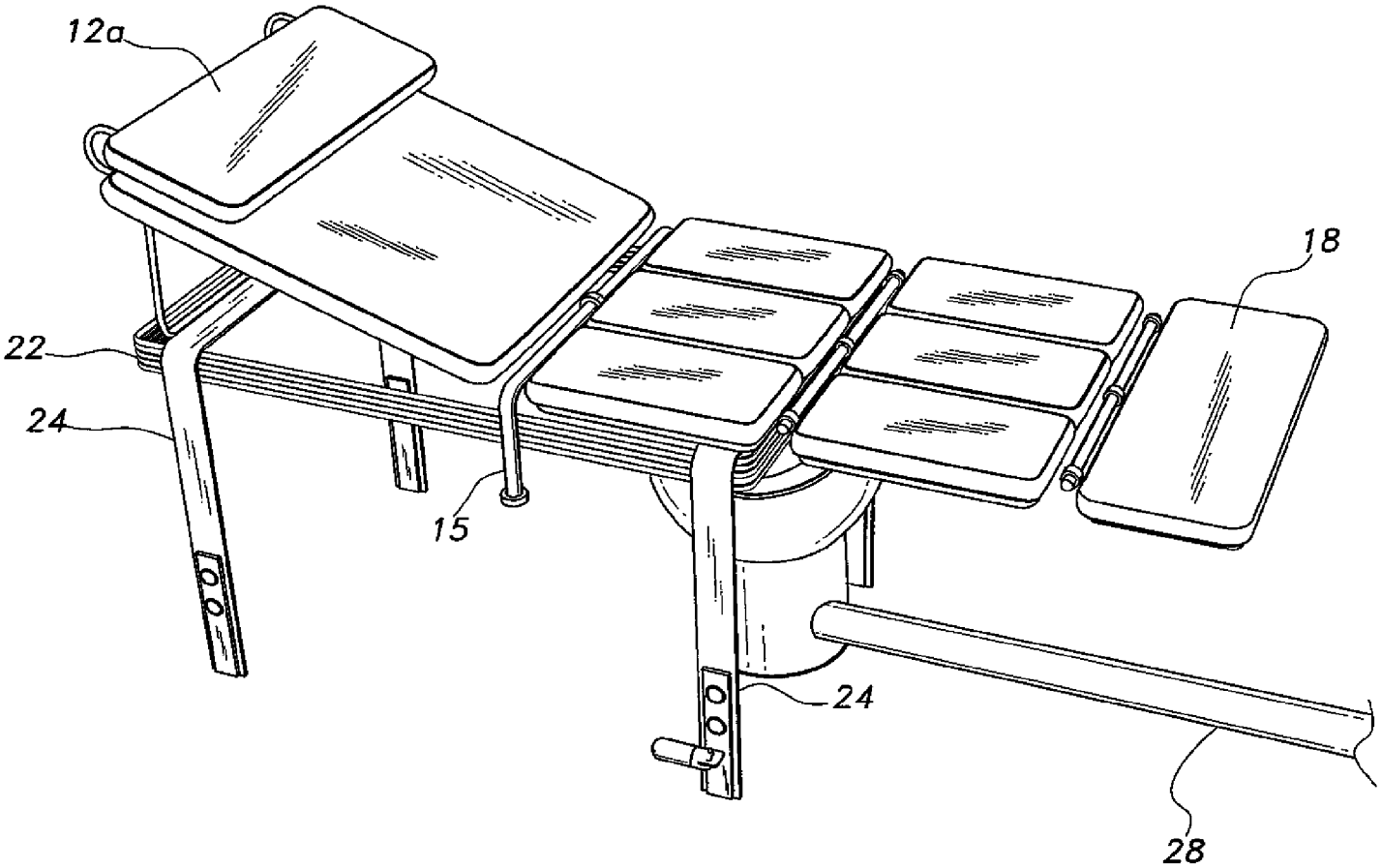
FIG. 3 is a perspective view of the multi-position bed of FIG. 1, shown with the back support portion in a semi-vertical position.

Referring to FIGS. 1-7 of the drawings, the multi-position bed for the infirm is generally indicated at 10. The bed 10 has a plurality of segments 12, 14, 16 and 18. Segment 12 is arranged and designed to support the back, neck, and head of a patient. Segment 12 includes a pillow or headrest portion 12*a*. The patient's buttocks are supported on segment 14. Segments 16 and 18, respectively, support the patient's lower legs and feet. Segments 14, 16 and 18 are pivotally attached adjacent an adjoining pivot rod 20. Segment 12 is pivotally attached adjacent a member rail 15. This construction allows the segments to be moved to various positions, as shown in the drawings, to enhance repositioning of the patient by the caregiver. The segments may be fabricated from any sturdy and suitable material (e.g., metal, wood, plastic, etc.) and are heavily padded to ensure patient comfort. The segments are supported on a metal frame 22. The frame 22 is provided with legs 24 that are vertically adjustable so that the bed may be positioned at a low height (FIG. 1) or an elevated height (FIG. 2) to facilitate moving and adjusting the position of the patient.

Figure 4:
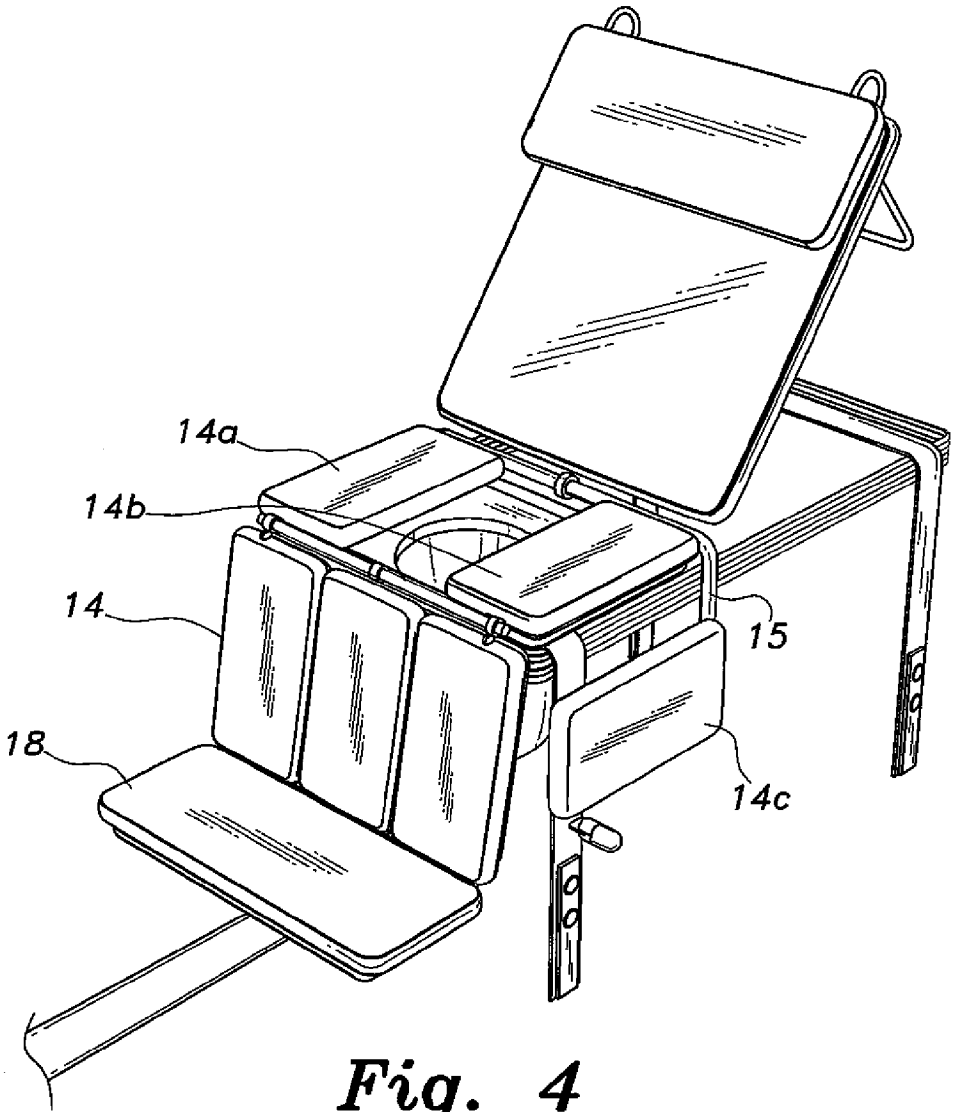
FIG. 4 is a perspective view of the multi-position bed of FIG. 1, shown with the back support portion in a vertical position and the toilet opening uncovered.
Figure 5:
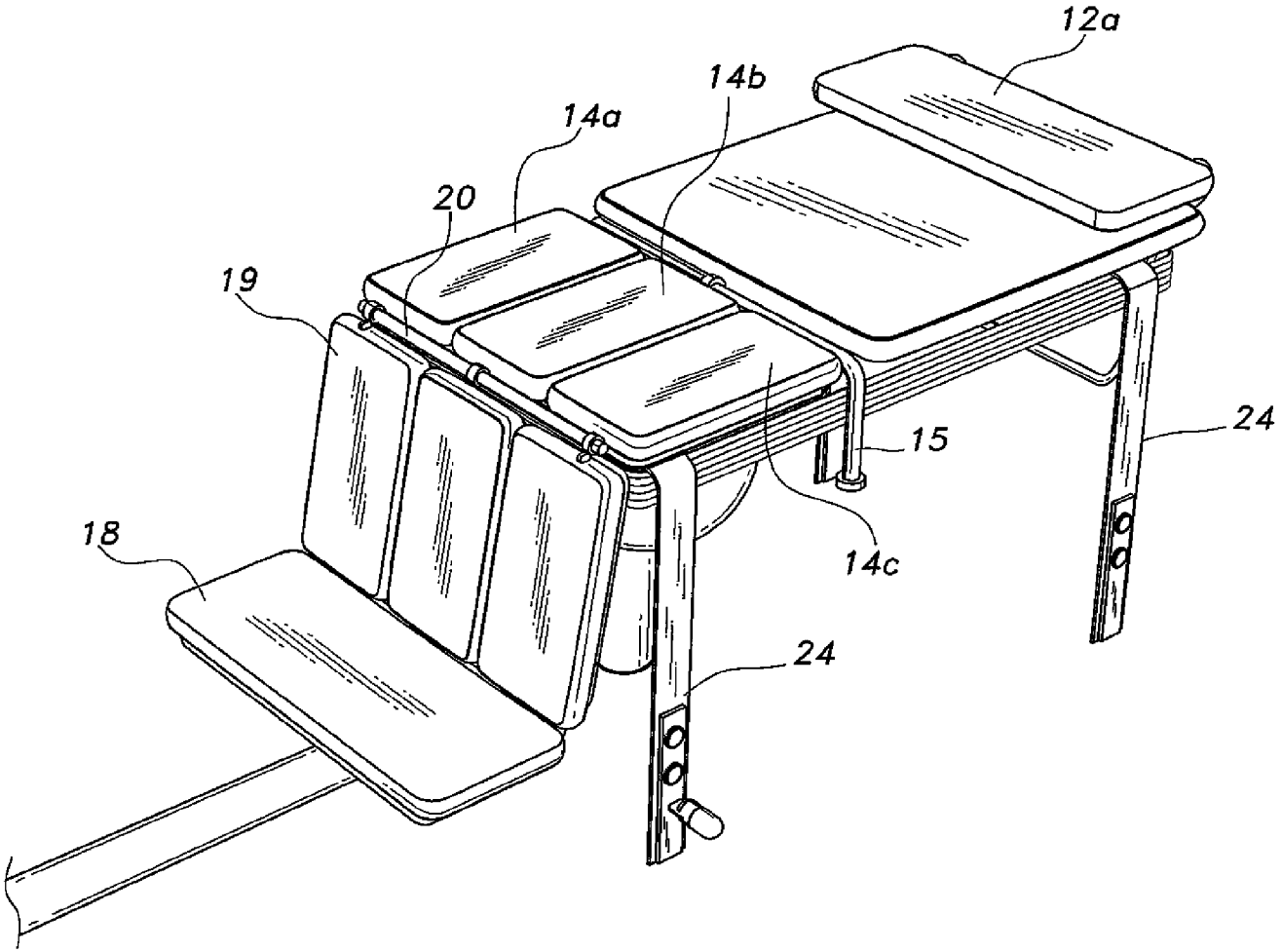
FIG. 5 is a perspective view of the multi-position bed of FIG. 1, shown with the foot support portion folded down.
Figure 6:
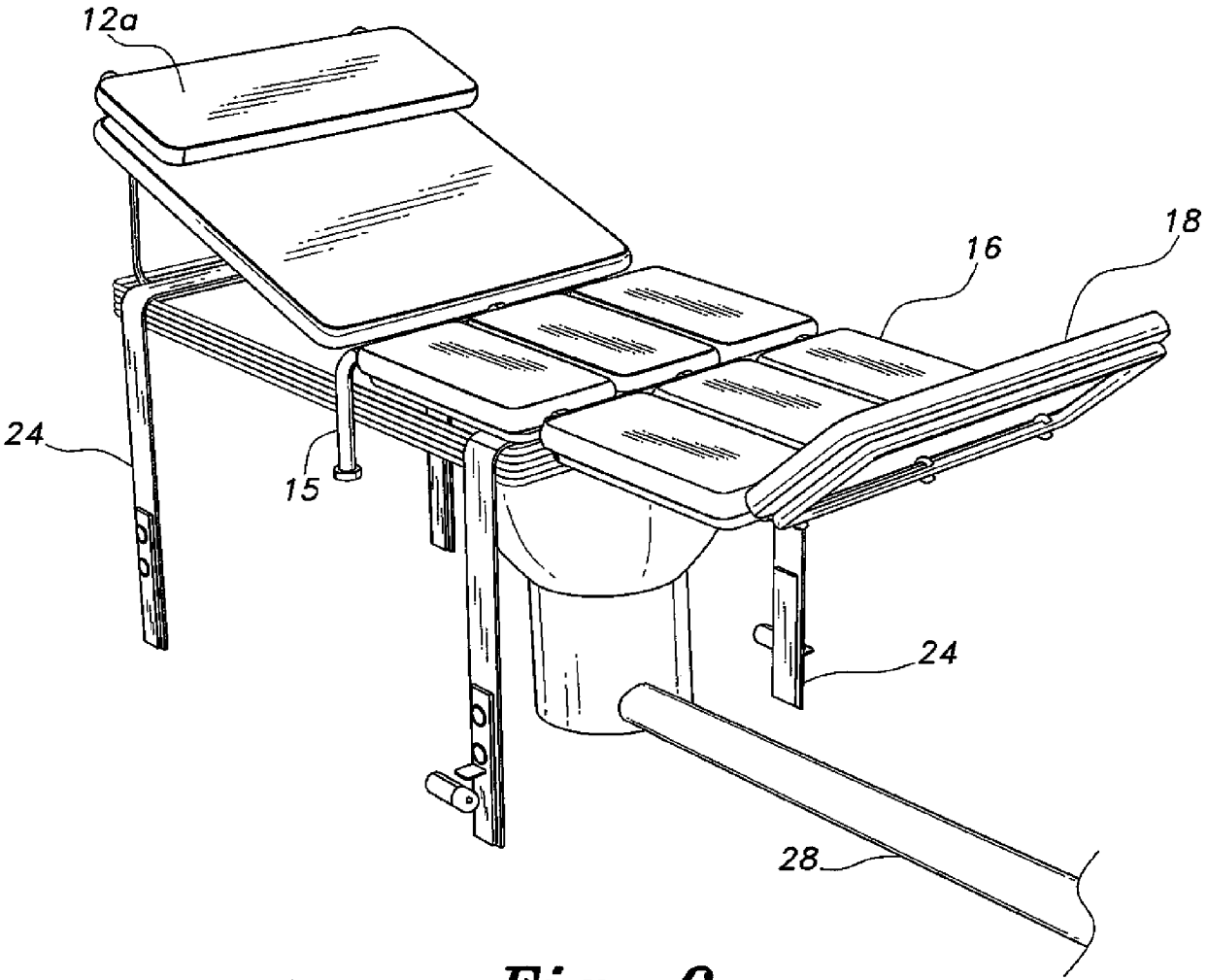
FIG. 6 is a perspective view of the multi-position bed of FIG. 1, shown with the foot support portion folded up.
Figure 7:
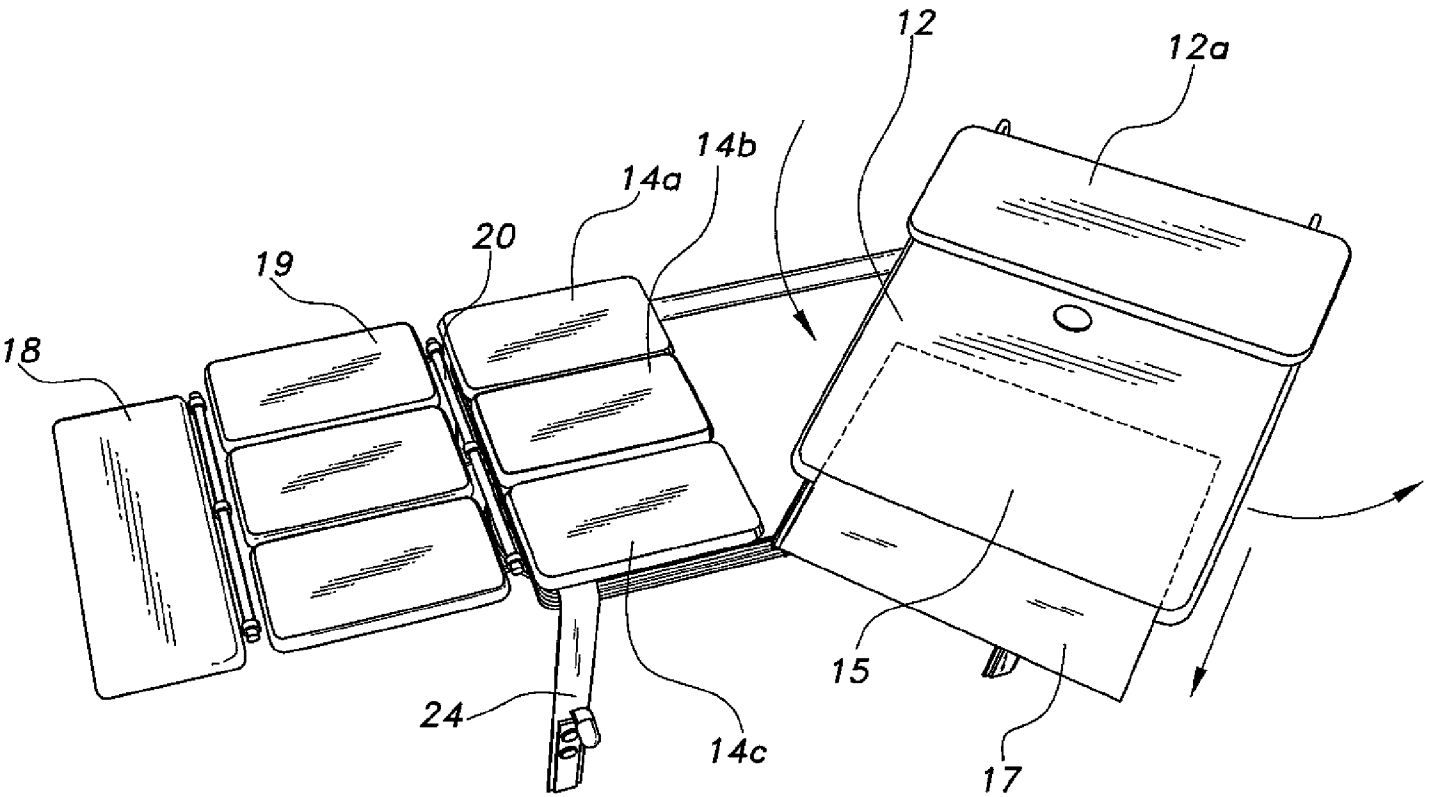
FIG. 7 is a perspective view of the multi-position bed of FIG. 1, showing the upper segment raised and rotated in a horizontal plane.

Segment 14 comprises three panels 14*a*, 14*b*, 14*c*, which are mounted on rail 15 for horizontal sliding movement thereon. This arrangement permits one of the side panels 14*c* to be moved to an overhang position and the central panel 14*b* to be moved to a side position, thereby creating an opening in segment 14, as shown in FIG. 4. A toilet 26 is fixed beneath the bed 10 in alignment with the opening in segment 14. The toilet may be provided with steel legs (not shown) for additional support. A conduit 28 extends from the toilet 26 to evacuate flush water and waste therefrom.

As noted above, and shown in FIG. 7, segment 12 can be independently raised and rotated through 360° in a horizontal plane. Segment 12 encloses a panel 17 therein. The panel 17 is slidable out of segment 12 to form a support for the lower part of the patient's body. This arrangement permits the disabled patient to be moved in a horizontal plane, if necessary, to receive medical treatment or the like.

It is to be understood that the present invention is not limited to the embodiments described above, but encompasses any and all embodiments within the scope of the following claims.

I claim:

1. A multi-position bed for an infirm patient, comprising:

a frame member;

a plurality of legs mounted to the frame member and extending downward therefrom;

a support surface mounted on the frame member, the support surface being adapted to support the infirm patient, the support surface being formed from a plurality of attached segments including a back and head supporting segment, said back and head supporting segment being optionally raised and rotatable in a horizontal plane;

an extendable panel enclosed within the back and head supporting segment; and a toilet fixed beneath the support surface.

2. The multi-position bed according to claim 1, wherein said plurality of attached segments includes a foot supporting segment, a lower leg supporting segment adjacent the foot supporting segment, a buttocks supporting segment adjacent the lower leg supporting segment, and wherein the back and head supporting segment being adjacent the buttocks supporting segment.

3. The multi-position bed according to claim 2, wherein the toilet is fixed beneath the buttocks supporting segment.

4. The multi-position bed according to claim 1, wherein said legs are vertically adjustable.

5. The multi-position bed according to claim 1, wherein adjacent segments are pivotally attached.

6. The multi-position bed according to claim 1, further including a pillow disposed on the back and head segment.

7. A multi-position bed for an infirm patient, comprising:

a frame member;

a plurality of legs mounted to the frame member and extending downward therefrom, the legs being vertically adjustable;

a support surface mounted on the frame member, the support surface being adapted to support the infirm patient, the support surface having a plurality of adjacently positioned, pivotally attached segments forming the support surface, wherein said plurality of attached segments includes a buttocks supporting segment;

an L-shaped rail member attached to and extending across said frame member;

three panel members mounted on the rail member for sliding movement thereon, whereby the panel members can be positioned on the rail and frame members to create an opening in the buttocks supporting segment; and a toilet fixed beneath the support surface.

8. The multi-position bed according to claim 7, wherein said plurality of attached segments includes a foot supporting segment, a lower leg supporting segment adjacent the foot supporting segment, wherein the buttocks supporting segment being adjacent the lower leg supporting segment, and a back and head supporting segment adjacent the buttocks supporting segment.

9. The multi-position bed according to claim 8, wherein the toilet is fixed beneath the buttocks supporting segment.

10. A multi-position bed for an infirm patient, comprising:

a frame member;

a plurality of legs mounted to the frame member and extending downward therefrom, the legs being vertically adjustable;

a support surface mounted on the frame member, the support surface being adapted to support the infirm patient, the support surface having a plurality of adjacently positioned, pivotally attached segments forming the support surface, including a foot supporting segment, a lower leg supporting segment adjacent the foot supporting segment, a buttocks supporting segment adjacent the lower leg supporting segment, and a back and head supporting segment adjacent the buttocks supporting segment, said back and head supporting segment being optionally raised and rotatable in a horizontal plane;

an extendable panel enclosed within said back and head supporting segment;

a pillow disposed on the back and head supporting segment; and a toilet fixed beneath the buttocks supporting segment.

11. The multi-positioned bed according to claim, 10 wherein the buttocks supporting segment further comprises:

an L-shaped rail member attached to and extending across said frame member;

three panel members mounted on the rail member for sliding movement thereon, whereby the panel members can be positioned on the rail and frame members to create an opening in the buttocks supporting segment.

* * * * *